US011479442B2

(12) United States Patent
Chiappa et al.

(10) Patent No.: US 11,479,442 B2
(45) Date of Patent: Oct. 25, 2022

(54) METHOD FOR MONITORING CHARACTERISTICS OF A DOOR MOTION PROCEDURE OF AN ELEVATOR DOOR USING A SMART MOBILE DEVICE

(71) Applicant: Inventio AG, Hergiswil (CH)

(72) Inventors: Alberto Chiappa, Ecublens VD (CH); Martin Kusserow, Lucerne (CH); Zack Zhu, Baar (CH)

(73) Assignee: INVENTIO AG, Hergiswil (CH)

( * ) Notice: Subject to any disclaimer, the term of this patent is extended or adjusted under 35 U.S.C. 154(b) by 185 days.

(21) Appl. No.: 16/959,207

(22) PCT Filed: Apr. 10, 2019

(86) PCT No.: PCT/EP2019/059006
§ 371 (c)(1),
(2) Date: Jun. 30, 2020

(87) PCT Pub. No.: WO2019/206624
PCT Pub. Date: Oct. 31, 2019

(65) Prior Publication Data

US 2021/0032078 A1 Feb. 4, 2021

(30) Foreign Application Priority Data

Apr. 26, 2018 (EP) ..... 18169453

(51) Int. Cl.
*B66B 5/00* (2006.01)

(52) U.S. Cl.
CPC ..... *B66B 5/0018* (2013.01); *B66B 5/0087* (2013.01)

(58) Field of Classification Search
CPC ..... B66B 13/02; B66B 5/0037; B66B 5/0087; B66B 5/0018
See application file for complete search history.

(56) References Cited

U.S. PATENT DOCUMENTS 4,300,663 A * 11/1981 Hmelovsky ..... E05F 15/632 318/617
7,484,598 B2 * 2/2009 Tyni ..... B66B 5/0025 187/291

(Continued)

FOREIGN PATENT DOCUMENTS

CN 105452139 A 3/2016
JP S54140340 A 10/1979

(Continued)

*Primary Examiner* — Michael A Riegelman
(74) *Attorney, Agent, or Firm* — William J. Clemens; Shumaker, Loop & Kendrick, LLP

(57) ABSTRACT

A method and a device for monitoring characteristics of an elevator door motion procedure use a smart mobile device including multiple sensors. The method includes: (i) determining a time window, within which a door motion is assumed to occur, including a time interval enclosed by a start time limit and an end time limit and wherein at least one of the start time limit and the end time limit is determined based on first measurement values acquired by a first sensor in the smart mobile device; and (ii) detecting characteristics of the procedure based on second measurement values acquired during the time window by a second sensor in the smart mobile device. Using the method, door motion characteristics can be reliably monitored using a passenger's smart mobile phone while substantially limiting sensing and processing capacities required by the smart mobile phone as well as avoiding compromising passenger privacy requirements.

18 Claims, 3 Drawing Sheets

15 PROCESSOR
17 MEMORY
19 INTERFACE
21 REMOTE MONITORING DEVICE
45 BEACON SIGNAL RECEIVER SENSOR
47 LIGHT SENSOR
49 ACCELERATION SENSOR
51 GYROSCOPE SENSOR
53 BAROMETER SENSOR
55 MAGNETOMETER SENSOR

(56) References Cited

U.S. PATENT DOCUMENTS

| | | | | |
|---|---|---|---|---|
| 7,928,678 | B2 * | 4/2011 | Imai | B60J 5/06 49/324 |
| 8,678,143 | B2 * | 3/2014 | Bunter | B66B 5/0025 187/247 |
| 10,112,801 | B2 * | 10/2018 | Madarasz | B66B 5/0037 |
| 10,196,236 | B2 | 2/2019 | Sonnenmoser et al. | |
| 10,341,441 | B2 * | 7/2019 | Kinnari | G07C 9/38 |
| 2007/0016332 | A1 * | 1/2007 | Tyni | B66B 5/0037 700/47 |
| 2011/0067958 | A1 * | 3/2011 | Schuster | B66B 5/0006 187/393 |
| 2015/0284214 | A1 * | 10/2015 | Park | B66B 5/0025 187/393 |
| 2016/0130114 | A1 * | 5/2016 | Wilke | B66B 5/0025 187/393 |
| 2017/0029244 | A1 * | 2/2017 | Madarasz | B66B 5/0037 |
| 2018/0201476 | A1 * | 7/2018 | Laakso | E05F 15/40 |
| 2019/0010019 | A1 * | 1/2019 | Koushik | B66B 13/24 |
| 2019/0010021 | A1 * | 1/2019 | Sarkar | B66B 5/0025 |
| 2019/0193986 | A1 * | 6/2019 | Studer | B66B 1/3492 |
| 2019/0193992 | A1 * | 6/2019 | Studer | B66B 5/0025 |
| 2019/0352134 | A1 * | 11/2019 | Tscuppert | B66B 19/007 |
| 2019/0382238 | A1 * | 12/2019 | Witczak | B66B 5/0018 |
| 2020/0002127 | A1 * | 1/2020 | Kusserow | B66B 5/0037 |
| 2020/0109030 | A1 * | 4/2020 | Zhu | B66B 5/0031 |
| 2020/0198933 | A1 * | 6/2020 | Kusserow | B66B 13/06 |
| 2021/0032078 | A1 * | 2/2021 | Chiappa | B66B 5/0087 |
| 2021/0139274 | A1 * | 5/2021 | Tschuppert | B66B 27/00 |
| 2022/0119224 | A1 * | 4/2022 | Blanchard | B66B 5/0025 |

FOREIGN PATENT DOCUMENTS

| | | | |
|---|---|---|---|
| JP | 2008120471 | A | 5/2008 |
| WO | 2014200457 | A1 | 12/2014 |
| WO | 2015022185 | A1 | 2/2015 |
| WO | 2018050470 | A1 | 3/2018 |
| WO | 2019034376 | A1 | 2/2019 |

* cited by examiner

15 PROCESSOR
17 MEMORY
19 INTERFACE
21 REMOTE MONITORING DEVICE
45 BEACON SIGNAL RECEIVER SENSOR
47 LIGHT SENSOR
49 ACCELERATION SENSOR
51 GYROSCOPE SENSOR
53 BAROMETER SENSOR
55 MAGNETOMETER SENSOR

METHOD FOR MONITORING CHARACTERISTICS OF A DOOR MOTION PROCEDURE OF AN ELEVATOR DOOR USING A SMART MOBILE DEVICE

FIELD

The present invention relates to a method for monitoring characteristics of a door motion procedure of an elevator door using a smart mobile device. Furthermore, the invention relates to a smart mobile device and a computer program product for executing or controlling the proposed method and to a computer readable medium comprising such computer program product stored thereon.

BACKGROUND

In elevators, an entry to or an exit from an elevator car may be opened and closed by an elevator door. The elevator door may be a car door, i.e. the elevator door may be part of the elevator car. Alternatively or additionally, the elevator door may be a shaft door, i.e., an elevator door may be provided at stationary locations in an elevator shaft at each of multiple floors. Upon the elevator door being opened, passengers may enter or exit the elevator car. Upon the elevator door being closed, the elevator car may be displaced vertically within an elevator shaft.

On the one hand, operation of the elevator door has to be reliable in order to prevent for example risks for passengers. For example, the elevator door shall reliably close before the elevator car is allowed to be displaced throughout the elevator shaft. On the other hand, the elevator door should be moved quickly in order to reduce waiting periods for the passengers.

While, in an initial state directly after installation of the elevator, elevator door operation is generally adapted and optimized such as to fulfil the above requirements, the elevator door operation may deteriorate over time, for example due to wear, malfunctions or defects. Upon such deterioration, the elevator door may for example move slower than in its initial state and/or may no more completely or correctly close.

Accordingly, it may be necessary to monitor characteristics of a door motion procedure of the elevator door in order to detect for example malfunctions or damages. Preferably, such monitoring should be performed with no or only few human interaction, i.e. a requirement of inspections by a technician should be reduced to a minimum. Various approaches for such monitoring have been proposed.

For example, WO 2015/022185 A1 describes a monitoring system of an elevator installation with a monitoring system of an elevator door in which an evaluation unit being configured to determine an operation state of the elevator door based on a time profile of a physical parameter such as light intensity or color temperature.

EP 17186582 A1 discloses a method and monitoring device for monitoring an operation of an elevator door arrangement. Therein, the method comprises a learning phase and an application phase. During the learning phase, different types of door motion events are identified and reference motion event durations are learned for each type of door motion event. Then, during the application phase, different types of door motion events are distinguished upon comparison of the learned reference motion event durations with actual motion event durations.

WO 2018/050470 A1 describes a method for supervising an elevator arrangement. Therein, a mobile device activates a measuring mode upon detecting that it is located close to an elevator shaft door. Upon such activation, the mobile device acquires measuring values in the elevator car using an integrated sensor and transmits these measurement values to a central evaluation unit.

There may be a need for an alternative approach for monitoring characteristics of a door motion procedure of an elevator door. Particularly, there may be a need for a method enabling such monitoring using a smart mobile device. More specifically, a smart mobile device should be usable, on the one hand, upon reliably monitoring characteristics of the door motion procedure while, on the other hand, protecting the privacy of the person carrying the smart mobile device. Furthermore, there may be a need for a smart mobile device and a computer program product being specifically configured for implementing such method and for a computer readable medium storing such computer program product.

SUMMARY

Such needs may be met with the subject-matter of the advantageous embodiments defined in the following specification.

According to a first aspect of the present invention, a method for monitoring characteristics of a door motion procedure of an elevator door using a smart mobile device including multiple sensors is proposed. The method comprises at least the following steps, preferably in the indicated order:

(i) A time window within which a door motion is assumed to occur is determined. Therein, a start time limit and an end time limit enclose a time interval of the time window. At least one of the start time limit and the end time limit is determined based on first measurement values acquired by a first sensor comprised in the mobile device.

(ii) The characteristics of the door motion procedure of the elevator door are detected based on second measurement values acquired during the time window by a second sensor comprised in the mobile device.

According to a second aspect of the present invention, a device is proposed, the device being configured to executing and/or controlling a method according to an embodiment of the first aspect of the invention.

According to a third aspect of the invention, a computer program product is proposed, the computer program product comprising computer readable instructions which, when performed by a processor of e.g. a smart mobile device or of an elevator controller, instruct the processor to perform the method according to an embodiment of the first aspect of the invention.

According to a fourth aspect of the invention, a computer readable medium is proposed, the computer readable medium comprising a computer program product according to an embodiment of the third aspect of the invention stored thereon.

Ideas underlying embodiments of the present invention may be interpreted as being based, inter alia, on the following observations and recognitions.

The approaches described herein are aimed at monitoring an elevator door during its opening and closing motions in order to obtain information regarding characteristics of the door motion procedure. Therein, the monitoring shall be executed mainly or exclusively in an automated manner, i.e. using technical means.

Particularly, it is an idea to use smart mobile devices for acquiring data, which data then allows deriving the required characteristics of the door motion. Therein, a smart mobile device may be regarded as a portable or handheld device which may be easily carried by a person and which includes some sensors for sensing physical parameters in its environment and furthermore includes some computing power and/or data storing capacity for processing data acquired by the sensors. Additionally, the smart mobile device may comprise an interface or a wireless transmitter for transmitting data acquired by the sensors to an external device. The smart mobile device may be for example a smart phone, a tablet, a phablet, a notebook, a smart wearable, a smart watch, a smart band or a smart key chain. The smart mobile device may be owned and/or carried for example by a passenger using the elevator.

Generally, smart mobile devices comprise a multiplicity of different sensors. Each sensor may sense another physical parameter and may provide corresponding sensor signals. For example, modern smart phones typically comprise a camera, a microphone, a light sensor, an acceleration sensor, a gyroscope sensor, a barometer sensor, a beacon signal receiver sensor, etc. Each sensor may continuously or periodically issue sensor signals. Such sensor signals may be processed within the smart mobile device. Alternatively or additionally, the sensor's signals may be forwarded to external devices using e.g. wired or wireless interfaces and/or transmission methods.

In principle, a modern smart mobile device has sufficient sensor capabilities and/or computing power for sensing and/or evaluating physical parameters which are influenced by an opening or closing elevator door. Accordingly, the mobile device could continuously use some or all of its sensors for supervising physical characteristics influenced by an elevator door motion. However, the owner of the mobile device will generally not allow the device to spend significant portions of its capabilities for such specific purpose.

Specifically, it has been found to be difficult to, on the one side, extract sufficient data from the mobile device's sensor signals in order to derive information about characteristics of the door motion procedure while, on the other side, limiting the mobile device's sensing and computing power required for such purposes to an acceptable degree. Particularly, it appeared to be difficult to, on the one side, have enough sensor data for reliably detecting any malfunctions or damages in an elevator door operation, while, on the other side, no excessive portion of the device's capabilities is used only for this specific duty of monitoring the elevator door.

It is therefore proposed to reduce the amount of capabilities required for such specific elevator door monitoring using the method described herein.

Therein, for monitoring the characteristics of a door motion procedure, two steps are performed: in a first step, a time window is determined within which a door motion is assumed to occur; then, characteristics of the door motion procedure are determined based on measurement values acquired exclusively during this time window. Therein, the time window is defined based on first measurement values acquired by a first sensor comprised in the mobile device whereas the characteristics of the door motion procedure are determined based on second measurement values acquired by a second sensor comprised in the mobile device. The first sensor differs from the second sensor such that the first measurement values relate to other physical parameters than the second measurement values.

It is to be noted that the terms "first sensor" and "first measurement values" as well as "second sensor" and "second measurement values" shall be understood as representing names of the sensors and measurement values only but shall not be understood as representing any order. Particularly, the smart mobile device may comprise various different first sensors all of which being different from the second sensor or sensors and measuring various first measurement values all of which being different from the second measurement values.

Particularly, the time window within which the door motion is assumed to occur is determined by setting a start time limit and an end time limit enclosing a time interval of the time window. For example, the first measurement values acquired by the first sensor may be evaluated and searched for specific signal patterns which typically occur shortly before and after, respectively, a door motion procedure. Upon detecting such representing specific signal patterns, the start time limit and the end time limit, respectively, may be set, thereby defining the time window. So, the first sensor could be named as a "segmentation sensor".

Subsequently, second measurement values acquired by the second sensor during the time window may be evaluated such as to derive information about the characteristics of the door motion procedure. Particularly, the second measurement values may be scanned for specific signal patterns which typically occur during a door motion procedure. Characteristics of such specific signal patterns might provide hints to normal door operation or to any malfunctions in door operation. So, the second sensor could be named as a "pattern recognition sensor".

Accordingly, by applying the described two-step approach, acquiring and/or evaluating second measurement values by a second sensor in a second step may be limited to times during the time window having been defined in a preceding first step. Accordingly, the smart mobile device's power required for monitoring the elevator door motion characteristics may be reduced regarding both, sensors signal acquisition as well as sensors signal evaluation. Furthermore, a reliability of the detected door motion characteristics may be improved as the second measurement values are only scanned for the occurrence of characteristic door motion patters during the time window in which, based on the information derived from other first measurement values, a door motion is assumed to actually occur.

According to an embodiment, the door motion procedure comprises a first door motion including a closing of the elevator door and a second door motion including a subsequent re-opening of the elevator door. Therein, a start time limit of the first door motion and an end time limit of the second door motion form outer time extent limits and an end time limit of the first door motion and a start time limit of the second door motion form inner extent time limits. Under such conditions, the outer extent time limits may be determined based on first measurement values acquired by a first sensor of a first type comprised in the mobile device and the inner extent time limits may be determined based on first measurement values acquired by a first sensor of a second type comprised in the mobile device.

In other words, an entire door motion procedure may be interpreted as including both, the closing of the elevator door before the elevator car is started to be displaced as well as the opening of the elevator door upon the elevator car having reached its target floor. Expressed differently, the door motion procedure may comprise all door motions between two stops of the elevator car at different floors. In such interpretation, outer time extent limits may be those time limits occurring just before the elevator door closes or just after the elevator door re-opened. The inner time extent limits may be those time limits occurring just after the elevator door closed or just before the elevator door re-opens.

In such interpretation, those start and end time limits representing outer extent time limits may be determined based on first measurement values acquired by a sensor being of a first type of first sensors whereas those start and end time limits representing inner extent time limits may be determined based on first measurement values acquired by another sensor being of a second type of first sensors. In other words, the time limits for the outer extent time limits and the inner extent time limits may be determined using sensor signals from different first sensors, wherein, while being different with respect to each other, all first sensors differ from the second sensor as used for detecting the characteristics of the door motion procedure within the defined time window.

According to an embodiment the method begins with filtering the first measurement values acquired by the first sensor, wherein it is looked for characteristic signatures in the first measurement values. The named characteristic signatures are typical of an elevator trip. I.e. it may be looked for characteristic acceleration and/or deceleration signatures which are unique to forces experienced by a smart mobile device upon taking an elevator. A goodness of a fit with the named characteristic signatures could filter or rather select signals or rather time-intervals of signals for further processing. So, the monitoring method includes, first, a trip filtering, then a segmentation of door motion procedures or events and, finally, a door motion procedure recognition.

According to an embodiment, each of the first sensor and the second sensor is a sensor other than a camera or a microphone. In other words, none of the first sensor and the second sensor is a camera or a microphone.

While, in principle, all sensors included in a smart mobile device could be used as first and second sensors for providing the first and second measurement values in the proposed monitoring method, privacy issues may prevent that specific ones of those sensors may be used for the proposed purpose. Particularly, owners of a smart mobile device may want to protect their privacy by not allowing software applications ("apps") to use the device's camera and microphone.

However, for implementing the monitoring method proposed herein, it is not necessary to use signals from the camera or microphone. Instead, sensor signals from various other sensors may be used for providing the first and second measurement values required in the proposed monitoring method.

Particularly, according to an embodiment, the first sensor may be a beacon signal receiver sensor, a light sensor, an acceleration sensor, a gyroscope sensor or a barometer sensor.

Furthermore, according to an embodiment, the second sensor may be a magnetometer sensor.

Specifically, according to an embodiment, the first sensor may be a beacon signal receiver sensor and one of the start time limit and the end time limit of the time interval may be determined based on detecting a beacon signal obtained by the beacon signal receiver sensor.

Herein, a beacon signal receiver sensor shall be understood as a sensor which may receive and detect a beacon signal. A beacon signal may be a signal which is generally emitted by another device and which may indicate that the other device is located in a direct neighborhood to the present location. For example, in elevator arrangements, beacon signal emitting devices may be provided at locations close to the elevator door and/or at locations within the elevator car. Generally, a beacon signal may be any signal that could be transmitted wirelessly and has a specific beacon signal pattern. For example, a beacon signal may be a Bluetooth signal, a Wi-Fi signal, etc. Accordingly, the beacon signal receiver sensor may be a sensor receiving specific electromagnetic signals or signal patterns.

Accordingly, when the passenger approaches the elevator door together with its smart mobile device, the beacon signal receiver sensor in the smart mobile device may detect the beacon signal emitted by the beacon signal emitting device. Thus, based on the first measurement signal provided by the beacon signal receiver sensor, it may be detected that the smart mobile device is in a close neighborhood to the elevator door.

As a passenger typically approaches or steps through the elevator door just before entering the elevator car and, accordingly, the beacon signal is detected just before the elevator door is closed such that the passenger together with the elevator car may be displaced, receiving the beacon signal by the beacon signal receiver sensor may indicate a point in time to be interpreted as a start time limit or, more specifically, as a first outer extent time limit, defining the time window within which a subsequent door motion is assumed to occur. Similarly, when it is detected that the beacon signal receiver sensor loses the beacon signal, this may indicate a point in time to be interpreted as an end time limit or, more specifically, as a second outer extent time limit, for the time window.

As an alternative, according to an embodiment, the first sensor may be a light sensor and the start time limit or the end time limit of the time interval may be determined based on detecting a change in a light sensor signal obtained by the light sensor, the change in the light sensor signal exceeding one of a predetermined threshold light intensity variation value and a predetermined threshold light intensity variation rate value.

A light sensor shall be understood as a sensor which generates measurement values with magnitudes depending on a light intensity reaching the light sensor. Accordingly, in a dark environment, the light sensor produces another signal than in an illuminated environment. For example, a light sensor may be a simple photodiode. The light sensor may be included in the smart mobile device for example for measuring an ambient light intensity.

In many cases, when the passenger approaches an elevator door and/or enters an elevator car, a light intensity measured by the light sensor of his smart mobile device may detect a change in its light sensor signal. This may be due to the fact that the passenger goes from a brightly illuminated floor into the less illuminated elevator car. Alternatively, this may be due to the fact that the passenger, upon preparing for the elevator ride, takes his smart mobile device out of a dark pocket.

Accordingly, such changes in detected illumination at the light sensor may be taken as a hint or "fingerprint" indicating that the passenger with his smart mobile device is currently entering the elevator car and that, therefore, the elevator door will soon begin to close. Similarly, changes in detected illumination at the light sensor may be taken as indicating that the passenger with his smart mobile device is exiting the elevator car and that, therefore, the elevator door has just stopped to open.

Accordingly, when a change in the light sensor signal provided by the light sensor is detected and such change exceeds a predetermined threshold light variation value, this may be taken for setting the start time limit or the end time limit, respectively, or particularly for setting one of the outer extent time limits.

In an alternative or additional approach, instead of detecting an absolute or relative change in light intensity, a light intensity variation rate may be measured. Such light intensity variation rate value indicates how fast or abrupt a light intensity detected by the light sensor changes over time. Occurrence of sudden light intensity changes may be taken as indicating points in time just before or after a door motion procedure. Accordingly, when a change in the light sensor signal provided by the light sensor is detected and such light sensor signal change occurs faster than the predetermined threshold light intensity variation rate value, this may be taken for setting the start time limit or the end time limit, respectively, or particularly for setting one of the outer extent time limits.

As a further alternative, according to an embodiment, the first sensor may be an acceleration sensor and the start time limit or the end time limit of the time interval may be determined based on detecting a predetermined profile in an acceleration sensor signal obtained by the acceleration sensor.

In other words, the first sensor may act as an inertial measurement unit (IMU) measuring accelerations acting onto the sensor. The acceleration sensor may sense accelerations in one, two or preferably three dimensions. As the acceleration sensor is included in the smart mobile device, acceleration measurement values provided by the sensor include information about accelerations acting onto the smart mobile device. Such accelerations may be typical for specific actions taken by the holder of the mobile device or acting onto the holder of the mobile device.

For example, after a passenger entered the elevator car and the elevator door closed, the elevator ride begins and the elevator car together with the passenger and his mobile device will be accelerated in a vertical direction. Similarly, at the end of the elevator ride and just before the elevator door opens, the elevator car together with the passenger and his mobile device will be accelerated in an opposite vertical direction. A time-dependent pattern in an acceleration signal obtained by the acceleration sensor may have a typical profile regarding its magnitude and/or its time-dependent behavior. Accordingly, by evaluating the profile in the acceleration signal and analyzing it, i.e. for example comparing it to predetermined profiles, the start or end of an elevator ride may be detected. Accordingly, start and end time limits, or more specifically inner extent time limits, may be set.

As another alternative, according to an embodiment, the first sensor may be a gyroscope sensor and the start time limit or the end time limit of the time interval may be determined based on detecting a predetermined profile in a gyroscopic signal obtained by the gyroscope sensor.

A gyroscope sensor is a device used for measuring an orientation and/or an angular velocity. Accordingly, with the gyroscope sensor, the orientation and/or angular velocity of the smart mobile device may be measured. Similar to the preceding example regarding the acceleration sensor, gyroscopic signals from the gyroscope sensor may be used for detecting events typically occurring immediately before or after a door motion procedure. For example, such event may be detected by comparing the actual gyroscopic signal with a predetermined profile.

For example, in many cases, a passenger having entered the elevator car makes a 180° turn such as to look towards the car door. Such typical passenger motion may be detected based upon the gyroscopic signals measured by the gyroscope sensor and/or the acceleration signals measured by the acceleration sensor for example upon comparison with predetermined sensor signal profiles. As such passenger motion typically occurs just after the passenger having entered the elevator car and therefore just before the elevator door closes, the detected sensor signals may be taken for setting the start time limit for the time window of a closing door motion, or more specifically for setting the first outer extent time limit.

As still a further alternative, according to an embodiment, the first sensor may be a barometer sensor and the start time limit or the end time limit of the time interval may be determined based on detecting a change in a barometer pressure signal obtained by the barometer sensor, the change in the barometer pressure signal exceeding one of a predetermined threshold barometer pressure variation value and a predetermined threshold barometer pressure variation rate value.

A barometer sensor may sense an ambient air pressure. As the ambient air pressure depends on an altitude, the barometer pressure signal provided by the barometer sensor typically changes as soon as the elevator car together with the passenger and his smart mobile device begins to vertically displace during an elevator ride.

Accordingly, when detecting that the barometer pressure signal exceeds a predetermined threshold barometer pressure variation value, this may be taken as indicating that the elevator car is moving and that, therefore, the elevator door must have been closed a short while ago. Thus, such events may be taken for setting an end time limit for the closing door motion, or more specifically for setting the first inner extend time limit. An end of a continuously changing barometer pressure signal may indicate the end of the elevator ride and may therefore be used for setting the start time limit for the following opening door motion, or more specifically for setting the second inner extent time limit.

Additionally or as an alternative, it may be detected whether the change in a barometer pressure signal exceeds a predetermined threshold barometer pressure variation rate value, i.e. whether the measured ambient air pressure changes more rapidly than a predetermined threshold value. Therein, the predetermined threshold value may be set sufficiently high such that slow ambient air pressure changes are ignored but fast air pressure changes as typically occurring during an elevator ride are detected.

According to an embodiment, the second sensor may be a magnetometer sensor. Then, characteristics of the door motion procedure may be determined based on detecting a predetermined profile in a magnetometer sensor signal obtained by the magnetometer sensor.

A magnetometer sensor is configured for sensing a magnitude and/or direction of a magnetic field. The magnetic field may be static or may change dynamically.

Typically, in an elevator, an ambient magnetic field changes upon the elevator door being moved, as for example the elevator door or parts thereof are made from a ferromagnetic material such as steel. Accordingly, by measuring an ambient magnetic field for example within the elevator car, information about the elevator door motion may be obtained.

More specifically, magnetometer sensor signals received from the magnetometer sensor during the time window may be analyzed in order to derive information about characteristics of the door motion procedure. For example, predetermined profiles in the magnetometer signal may be detected, such predetermined profiles being representative for specific door motions or stages of a door motion. Therein, changes in characteristics of a door motion, such as e.g. a delayed closing due to wear effects or defects, typically result in an accompanying magnetic field being varied as well. By analyzing, for example, which typical profiles and/or when typical profiles are detected in a magnetometer sensor signal, the profiles representing specific door motions or stages of a door motion, valuable information about a correct operation or any malfunction of the elevator door may be obtained.

According to an embodiment, the start time limit and/or the end time limit may be determined based on various types of first measurement values acquired by various types of first sensors comprised in the mobile device.

In other words, one or more of the time limits defining the start or the end, respectively, of the time window in which a door motion is assumed to occur may be determined based not only on a single type of first measurement values but based on various different types of first measurement values. Expressed differently, a smart mobile device may comprise multiple different first sensors being configured for measuring different physical parameters. The multiplicity of different first sensors may be beneficially used for determining the time limits of the time window with a higher reliability.

For example, a start time limit or an end time limit may be determined based on a first type of first measurement values. A second type of first measurement values may then be used to check whether the determined start or end time limit is plausible or not. As, in such approach, when the time limits of the time window are set taking into account various different types of first measurement values, an overall reliability in setting the time limits may be increased.

The device according to the second aspect of the invention is specifically configured due to its hardware and/or software such as to execute or control the monitoring method proposed herein.

The device may be a smart mobile device including at least first and second sensors. The device itself may comprise a processor or central processing unit for processing the sensor signals provided by the first and second sensors.

Alternatively, the device may be a separate device which may receive sensor signal data provided by the smart mobile device and which may then process these sensor signal data in order to detect the characteristics of the door motion procedure. Such separate device may be for example a remote monitoring device being part of a remote control center which monitors the operation of an elevator. As a further alternative, the device may be a computer being e.g. part of a computer cloud.

The computer program product according to the third aspect of the invention may be programmed in any computer readable language. It may comprise instructions which, when performed on a processor or central processing unit of a device such as a smart mobile device or a remote monitoring device, result in executing or controlling the monitoring method proposed herein.

The computer readable medium according to the fourth aspect of the invention stores the computer program product in any technical manner, i.e. in a way such that the instructions of the computer program product may be read out from the computer readable medium by a machine. The computer readable medium may be for example a CD, a DVD, a flash memory, RAM, ROM, etc. The computer readable medium may also be the memory of an entire computer or server or of a data cloud. The computer program product may be downloaded from the computer readable medium directly or for example via a network such as the Internet.

It shall be noted that possible features and advantages of embodiments of the invention are described herein partly with respect to a monitoring method and partly with respect to a device for implementing such monitoring method. One skilled in the art will recognize that the features may be suitably transferred from one embodiment to another and features may be modified, adapted, combined and/or replaced, etc. in order to come to further embodiments of the invention.

In the following, advantageous embodiments of the invention will be described with reference to the enclosed drawings. However, neither the drawings nor the description shall be interpreted as limiting the invention.

The figures are only schematic and not to scale. Same reference signs refer to same or similar features.

DETAILED DESCRIPTION

Figure 1:
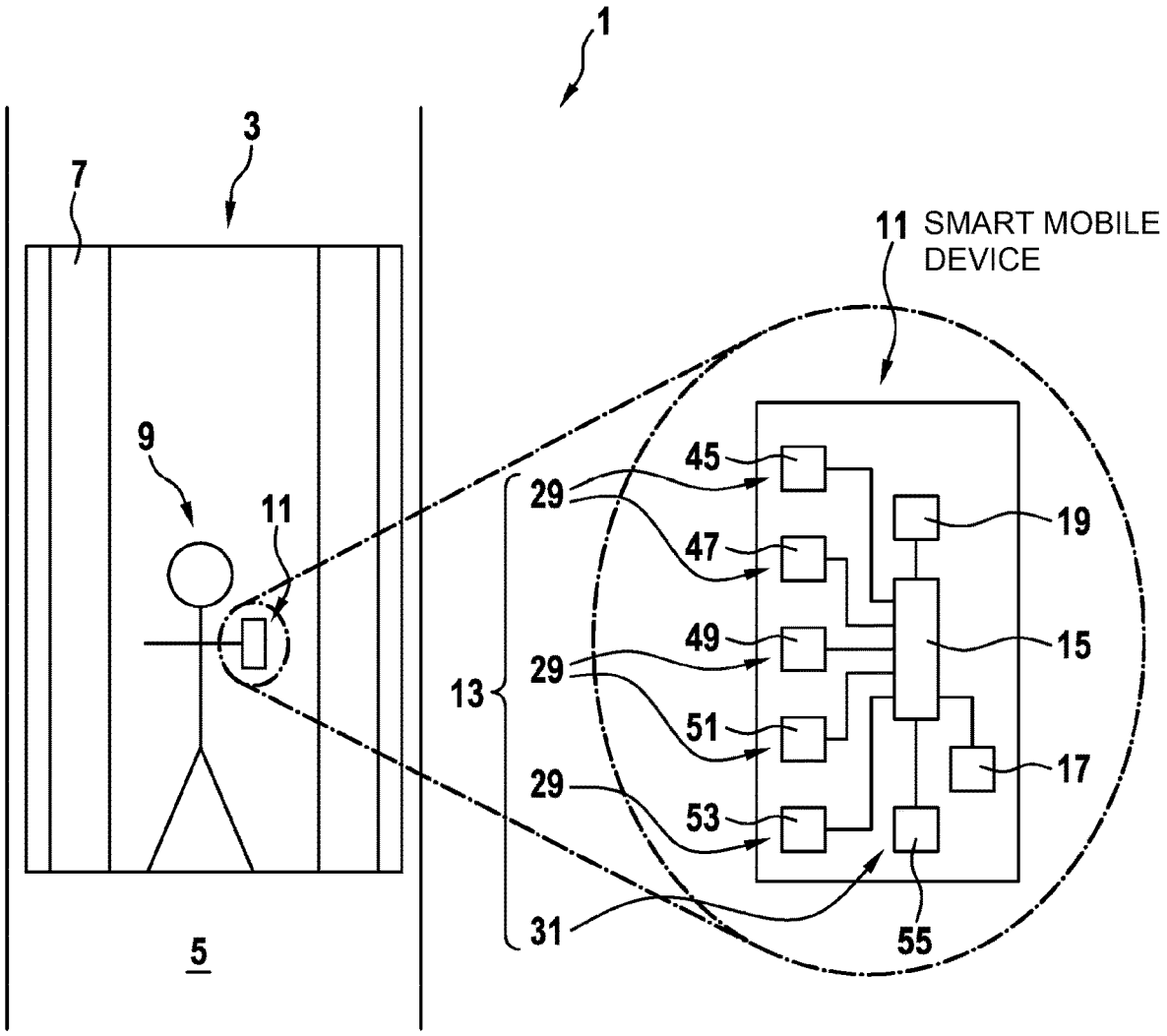
FIG. 1 shows a device and its environment in an elevator for executing a monitoring method according to an embodiment of the present invention.
Figure 1:
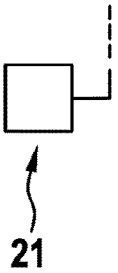

FIG. 1 shows an elevator 1 comprising an elevator car 3 to be displaced vertically along an elevator shaft 5. The elevator car 3 comprises an elevator door 7. The elevator door 7 may be opened and closed in door motion procedures such as to free or block, respectively, an access to the elevator car 3. Upon the elevator door 7 being opened, a passenger 9 may enter the elevator car 3. Subsequently, the elevator door 7 may be closed and the elevator car 3 may be displaced towards another floor.

The passenger 9 may carry a smart mobile device 11 such as a smart phone. The smart mobile device 11 comprises a multiplicity of sensors 13. The sensors 13 include multiple first sensors 29 and at least one second sensor 31. The first sensors 29 may include various different types of sensors 13 such as a beacon signal receiver sensor 45, a light sensor 47, an acceleration sensor 49, a gyroscope sensor 51 and a barometer sensor 53. The second sensor 31 may be a magnetometer sensor 55. Furthermore, the smart mobile device 11 comprises a processor 15 for processing sensor signals from the sensors 13. Additionally, the smart mobile device 11 comprises a memory 17 for storing data derived from the sensor signals. Finally, the smart mobile device 11 comprises an interface 19 for transmitting data or signals from the smart mobile device 11 to a remote monitoring device 21.

A problem which may be solved with the monitoring method described herein is to use a smart mobile device 11 such as the passenger's smart mobile phone, this smart mobile device 11 serving as a sensor box, wherein the smart mobile device 11 is used for detecting and/or monitoring characteristics of a door motion procedure of the elevator door 7 by non-permanently, opportunistically activating the sensor box. Therein, the smart mobile device 11 may use several of its sensors 13 for providing sensor signals based on which the characteristics of the door motion procedure may be derived. However, it is preferable to not use sensor signals provided by a camera or by a microphone of the smart mobile device 11 as analyzing signal data from such sensors may pose privacy concerns. Other sensors 13 such as an IMU (inertial measurement unit) including the acceleration sensor 49 or alternative sensors 13 such as the light sensor 47, the gyroscope sensor 51, the barometer sensor 53 or the beacon signal receiver sensor 45 do not elicit strong privacy concerns. However, signal variety from different orientations and/or placements of the passenger's smart mobile device 11 may have to be overcome, as the smart mobile device 11 may be for example held in the passenger's hand while reading information from its display, may be stored in a pocket or inside a purse, etc.

Figure 2:
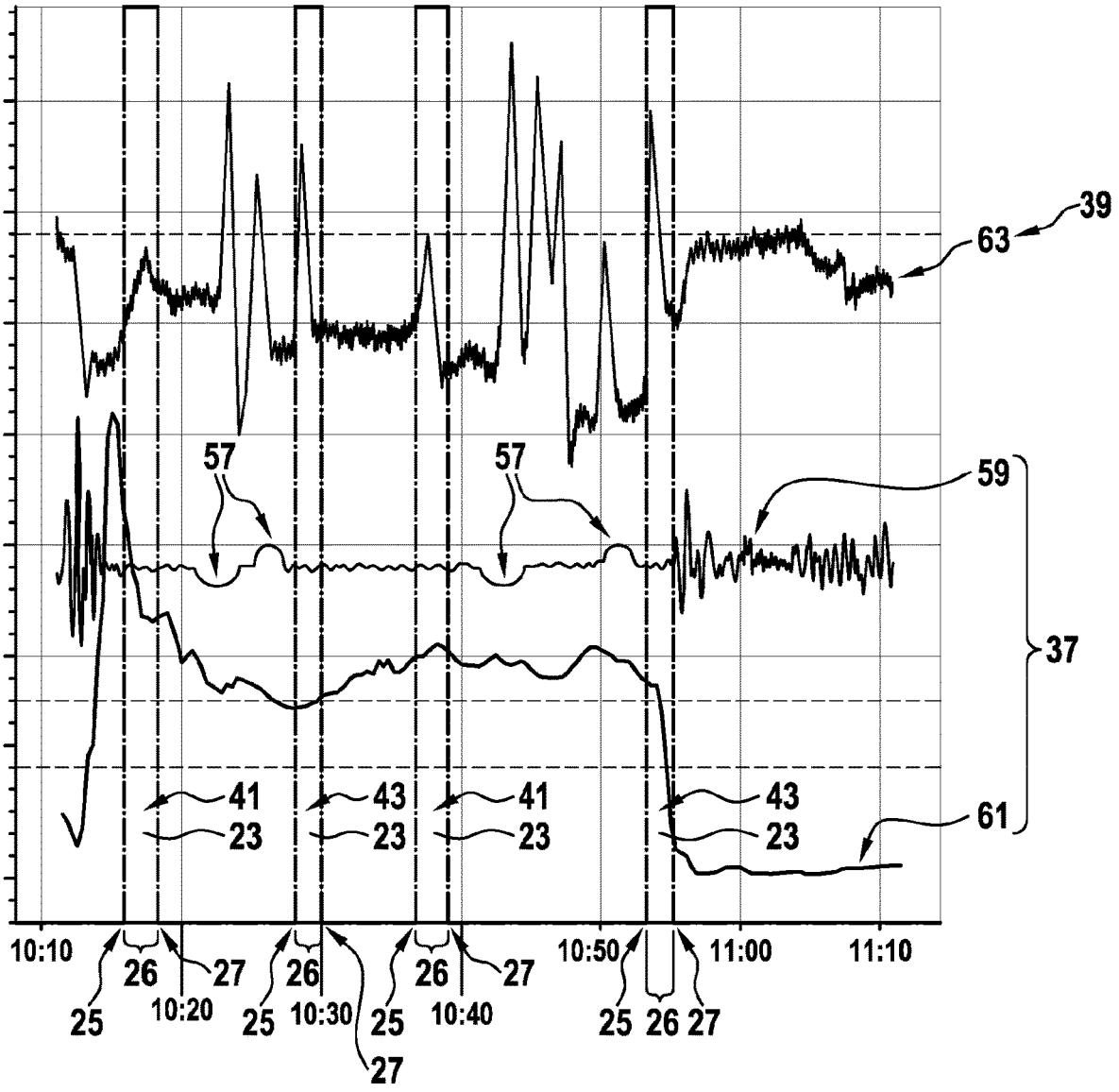
FIG. 2 shows time-dependent sensor signals analyzed in a monitoring method according to an embodiment of the present invention.
Figure 3:
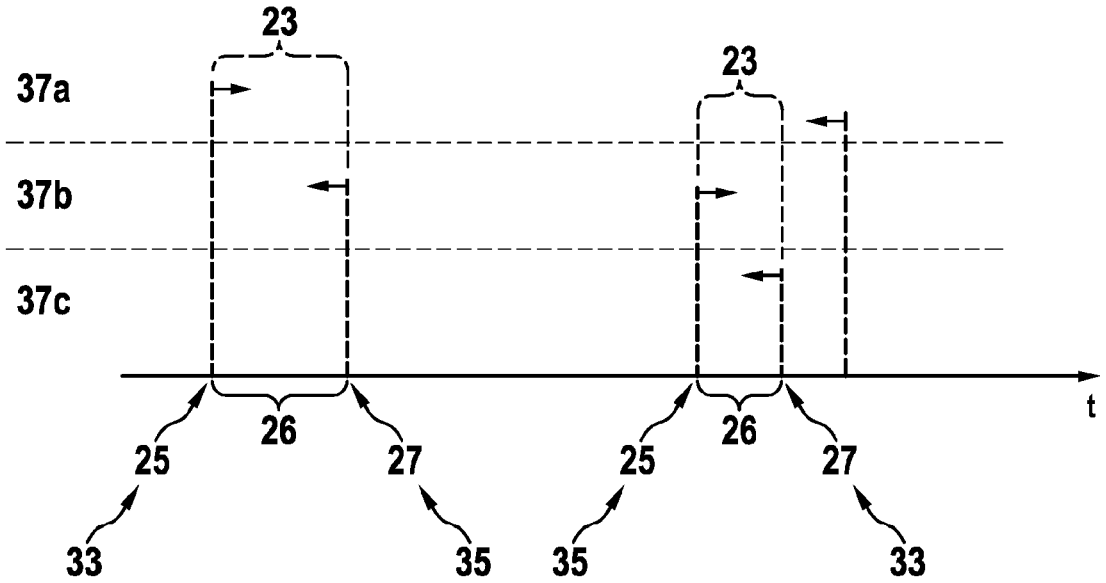
FIG. 3 shows a definition of a narrowest time window during a monitoring method according to an embodiment of the present invention.

In order to solve the mentioned problem, a two-step approach is suggested. Details of such approach will now be explained with reference to FIGS. 2 and 3. Therein, FIG. 2 shows an exemplary time-line along two subsequent elevator car trips of several sensor signals such as the acceleration sensor signal 59, the light sensor signal 61 and the magnetometer sensor signal 63. Each elevator trip begins with a first door motion 41 of closing the elevator door 7 and ends with a second door motion 43 of opening the elevator door 7. The various sensor signals provided by first sensors 29 including e.g. the beacon signal receiver sensor 45, the light sensor 47, the acceleration sensor 49, the gyroscope sensor 51 or the barometer sensor 53 form first measurement values 37. The sensor signals provided by the second sensor 31 including the magnetometer sensor 55 form second measurement values 39. FIG. 3 visualizes a process of determining a narrowest time window 23 based on various sensor signals.

In a first step of the suggested two-step approach, the time window 23 in which a door motion is assumed to occur is defined. Such defining of the time window 23 generally includes defining of a start time limit 25 and an end time limit 27 which enclose a time interval 26 of the time window 23. The start time limit 25 and the end time limit 27 are both determined based on first measurement values 37 acquired by one or more first sensors 29 of the smart mobile device 11.

In a second step, characteristics of the door motion procedure are then detected based on second measurements 39 acquired by the second sensor 31 of the smart mobile device 11, those second measurements 39 being acquired mainly or exclusively within the previously defined time window 23.

Assumptions underlying embodiments of the present invention are that it is possible to tie sensor data to the elevator installation that induced the data, e.g. via a Bluetooth beacon, Android Fused Location Provider using Wi-Fi, cell triangulation, GPS or similar localization data sources. Furthermore, offline processing of data should be possible, i.e. streaming data may be uploaded to a centralized server and/or analyzed periodically in batches.

In possible embodiments, the proposed monitoring method may include a filtering step, a segmentation step and a step of detecting door motion procedures. A goal is to generate narrowest possible extents in time, which is referred to herein as the "time window" 23, in which a door motion procedure could lie within a data stream. Specifically, the monitoring method may include, first, a trip filtering, then a segmentation of door motion procedures or events and, finally, a door motion procedure recognition.

In more detail, the monitoring method may begin with the step of trip filtering. As sensors 13 in a smart mobile device 11 may be recorded at any time without being near an elevator 1, it may be looked for characteristic acceleration and/or deceleration signatures which are unique to forces experienced by the smart mobile device 11 upon taking the elevator 1. For example, an L2-norm of 3-axis acceleration signals provided by an accelerations sensor 49 may be approximated by two Gaussian curves. A goodness of a fit could filter signals for further processing. A "fingerprint" of an acceleration typically occurring upon accelerating and/or decelerating the elevator car 3 at the beginning and/or the end of an elevator trip, respectively, may be represented by a predetermined typical profile 57 in the acceleration sensor signal 59 (see FIG. 2).

Subsequently, in the segmentation step, door motion procedures are to be detected. In other words, the goal of the segmentation phase is to determine time segments in which door motion events may lie. For such purpose, as exemplarily visualized in FIG. 3, start time limits 25 and end time limits 27, or, in an alternative interpretation, outer time extent limits 33 and inner time extent limits 35, may be determined for each elevator car trip based on various first measurement signals 37*a*, 37*b*, 37*c* obtained from different types of first sensors 29.

For example, beacon signal emitters may be provided at or close to elevator doors 7. Accordingly, a beacon signal receiver sensor 45 comprised in the smart mobile device 11 may detect a presence or absence of an emitted beacon signal when coming into a proximity of a beacon signal emitter. As the presence of the beacon signal is typically detected just before the elevator door 7 closes and the absence of the beacon signal is detected after the elevator door 7 opened again, this information may be used as first measurement values 37*a* for setting outer time extent limits 33, i.e. for setting a start time limit 25 before the closing door motion procedure and an end time limit 27 after the re-opening door motion procedure.

In some cases, significant changes in light intensity as sensed by the light sensor 47 and represented by first measurement values 37*c* may indicate that a passenger with his smart mobile device 11 has entered in or exited from the elevator car 3. Similar to the presence or absence of the first measurement signal 37*a* of the beacon signal, first measurement values 37*c* relating to significant light changes may be taken for setting outer time extent limits 33 for segmenting signals in order to narrow the time window 23, i.e. in order to shorten the time interval 26, thereby narrowing the search for door motion procedures.

Furthermore, due to e.g. a turning movement of the passenger 9 after having entered the elevator car 3 in order to face the elevator door 7 once inside the elevator car 3, a characteristic peak may occur in a gyroscopic signal (not shown) provided by the gyroscope sensor 51. The peak may be characteristic in angle and/or angular velocity. Accordingly, such information may be taken for setting outer time extent limits 33 or for verifying outer time extent limits 33 which were set based on other sensor signals.

If a barometer sensor 53 is available, a segment in which there is a non-zero first derivative in ambient pressure may be taken for setting inner time extent limits 35. In other words, a vertical displacement of the elevator car 3 is generally started just after the elevator door 7 has closed and ends just before the elevator door 7 opens again. As, during such vertical displacement, the ambient air pressure significantly changes, the measured barometer pressure variation (not shown) may be compared with a predetermined threshold barometer pressure variation value and/or the measured barometer pressure variation rate may be compared with a predetermined barometer pressure variation rate value in order to define the inner time extent limits 35.

As a further measure, first measurement values 37*b* corresponding to the acceleration sensor signal 59 from the acceleration sensor 49 may be used for setting the inner time extent limits 35. As elevator car deceleration generally precedes an elevator door opening motion and elevator car acceleration generally follows an elevator door closing motion, typical profiles in an acceleration sensor signal 59 may indicate corresponding start time limits 25 and end time limits 27.

Additionally, if available, activity recognition hardware onboard of modern smart mobile devices 11 may provide direct outputs such as "standing", "sitting" or "walking". For example, "standing" detection may be used directly as candidate segments.

Given the set of outer and inner time extent limits 33, 35 and/or corresponding start and end time limits 25, 27, the time window 23 defined by the enclosed time interval 26 may be set to the narrowest possible extent in which a door motion procedure is assumed to occur.

Finally, the door motion recognition may be implemented based on second measurement values 39 based on magnetometer sensor signals 63 obtained from the magnetometer sensor 55. Having segmented the narrowest possible time window 23 in which a door motion procedure lies, characteristic patterns or profiles in the magnetometer sensor signals 63 may be used to recognize and measure for example a duration of a door motion procedure. For example, peak shapes in a norm of the magnetometer sensor signals 63 may characterize the movement of a metallic elevator door 7 being positioned near the smart mobile device 11.

It is possible that single second measurement values 39 obtained by the smart mobile device 11 do not detect elevator door procedures correctly, for example due to the passenger 9 with his mobile device 11 standing at the back of the elevator car 3 where the magnetometer sensor 55 may not reliably sense magnetic field changes caused by an elevator door motion. However, upon receiving repeated second measurements 39 of the same equipment from many passengers' smart mobile devices 11, door motion procedures may be opportunistically spotted. Accordingly, a likelihood of successful door motion procedure detection may increase with increased usage of the method.

Overall, embodiments of the method presented herein provide a clearly-defined approach to tackle specific issues of door motion procedures from crowd-generated data. Need for hardware, connectivity and/or maintenance may be eliminated to a great degree. Furthermore, an objective third party installation insight and usage patterns may be provided.

Finally, it should be noted that the term "comprising" does not exclude other elements or steps and the "a" or "an" does not exclude a plurality. Also, elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for monitoring characteristics of a door motion procedure of an elevator door using a smart mobile device including multiple sensors, the method comprising the steps of:

determining a time window within which a door motion of the elevator door is assumed to occur including a start time limit and an end time limit enclosing a time interval of the time window and wherein at least one of the start time limit and the end time limit is determined based on first measurement values acquired by at least one first sensor of the multiple sensors of the smart mobile device; and detecting the characteristics of the door motion procedure of the elevator door based on second measurement values acquired during the time window by a second sensor of the multiple sensors of the smart mobile device.

2. The method according to claim 1 further comprising:

wherein the door motion procedure includes a first door motion of a closing of the elevator door and a second door motion of a subsequent re-opening of the elevator door;

wherein a start time limit of the first door motion and an end time limit of the second door motion form outer time extent limits and an end time limit of the first door motion and a start time limit of the second door motion form inner extent time limits;

wherein the at least one first sensor includes a first type first sensor and a second type first sensor;

determining the outer extent time limits based on the first measurement values acquired by the first type first sensor; and determining the inner extent time limits on the first measurement values acquired by the second type first sensor.

3. The method according to claim 1 including filtering the first measurement values acquired by the at least one first sensor and looking for characteristic signatures typical of a trip of an elevator car in the first measurement values.

4. The method according to claim 1 wherein each of the at least one first sensor and the second sensor is a sensor other than a camera and a microphone.

5. The method according to claim 1 wherein the at least one first sensor is one of a beacon signal receiver sensor, a light sensor, an acceleration sensor, a gyroscope sensor and a barometer sensor.

6. The method according to claim 1 wherein the second sensor is a magnetometer sensor.

7. The method according to claim 1 wherein the at least one first sensor is a beacon signal receiver sensor and wherein at least one of the start time limit and the end time limit of the time interval is determined based on detecting a beacon signal obtained by the beacon signal receiver sensor.

8. The method according to claim 1 wherein the at least one first sensor is a light sensor and wherein at least one of the start time limit and the end time limit of the time interval is determined based on detecting a change in a light sensor signal obtained by the light sensor, the change in the light sensor signal exceeding one of a predetermined threshold light intensity variation value and a predetermined threshold light intensity variation rate value.

9. The method according to claim 1 wherein the at least one first sensor is an acceleration sensor and wherein at least one of the start time limit and the end time limit of the time interval is determined based on detecting a predetermined profile in an acceleration sensor signal obtained by the acceleration sensor.

10. The method according to claim 1 wherein the at least one first sensor is a gyroscope sensor and wherein at least one of the start time limit and the end time limit of the time interval is determined based on detecting a predetermined profile in a gyroscopic signal obtained by the gyroscope sensor.

11. The method according to claim 1 wherein the at least one first sensor is a barometer sensor and wherein at least one of the start time limit and the end time limit of the time interval is determined based on detecting a change in a barometer pressure signal obtained by the barometer sensor, the change in the barometer pressure signal exceeding one of a predetermined threshold barometer pressure variation value and a predetermined threshold barometer pressure variation rate value.

12. The method according to claim 1 wherein the second sensor is a magnetometer sensor and wherein the characteristics of the door motion procedure are determined based on detecting a predetermined profile in a magnetometer sensor signal obtained by the magnetometer sensor.

13. The method according to claim 1 wherein at least one of the start time limit and the end time limit is determined based on various types of the first measurement values acquired by various types of the first sensors of the multiple sensors of the smart mobile device.

14. A device including a smart mobile device having multiple sensors and being adapted to at least one of execute and control the method according to claim 1.

15. A device including a smart mobile device and a remote monitoring device in communication and being adapted to execute and control the method according to claim 1.

16. The device according to claim 15 wherein the smart mobile device includes an interface for transmitting data or signals to the remote monitoring device.

17. A computer program product comprising non-transitory computer readable instructions which, when the instructions are performed by a processor, instruct the processor to perform the method according to claim 1.

18. A non-transitory computer readable medium comprising the computer program product according to claim 17 stored thereon.

* * * * *